US005120923A

United States Patent [19]

Kato et al.

[11] Patent Number: 5,120,923

[45] Date of Patent: Jun. 9, 1992

[54] PUSH BUTTON SWITCH

[76] Inventors: Takafumi Kato, 18-2 Oaza-Kamitamari, Tamari-Mura, Niihari-gun Ibaraki-ken; Kazutoshi Watanabe, 35-11-305 Murayama, Jobanshimofunao, Iwaki-shi, Fukushima-ken, both of Japan

[21] Appl. No.: 584,558

[22] Filed: Sep. 18, 1990

[30] Foreign Application Priority Data

Oct. 6, 1989 [JP] Japan ..... 1-117693
Dec. 22, 1989 [JP] Japan ..... 1-331150

[51] Int. Cl.[5] ..... H01H 13/14; H01H 13/26

[52] U.S. Cl. ..... 200/520; 200/517; 200/341; 200/342

[58] Field of Search ..... 200/517, 512, 520, 342, 200/341, 345

[56] References Cited

U.S. PATENT DOCUMENTS 3,780,237 12/1973 Seeger, Jr. et al. ..... 200/5 A
3,856,998 12/1974 Sims, Jr. ..... 200/5 A
4,164,634 8/1979 Gilano ..... 200/5 A
4,367,384 1/1983 Waarlé ..... 200/517
4,467,160 8/1984 Murmann et al. ..... 200/342 X
4,479,040 10/1984 Denley et al. ..... 200/517
4,613,737 9/1986 Nishijima ..... 200/342
4,631,378 12/1986 Nobesawa ..... 200/342
4,755,645 7/1988 Naoki et al. ..... 200/342 X
4,859,820 8/1989 Gotfryd et al. ..... 200/408
4,927,990 5/1990 Aoki et al. ..... 200/517

*Primary Examiner*—Ernest G. Cusick

[57] ABSTRACT

A push button switch including a case, a key top fastened to the case, an elastic member disposed between the case and the key top and acting to upwards urge the key top and a contact portioned so as to confront a spring member fastened to an operation member of the key top so that the contact portion is pressed by the spring member when the key top is depressed, the push button switch comprising: a movable member disposed between the operation member of the key top and a projection wall of the case whereby the operation member and the movable member can be moved with respect to each other and the movable member and the projection wall can be moved with respect to each other.

2 Claims, 6 Drawing Sheets

PUSH BUTTON SWITCH

BACKGROUND OF THE INVENTION

1. Field of the Invention

The present invention relates to a push button switch for use as a key switch for a data input apparatus for a personal computer, a word processor or the like, and, more particularly, to a push button switch the thickness of which can be easily reduced.

2. Related Art Statement

A conventional push button switch of the type described above will be described with reference to FIG. 13.

Referring to the drawing, reference numeral 1 represents a reinforcing plate made of metal or the like. A membrane switch 2, comprising an upper sheet 2*b* having a movable contact 2*a* and a lower sheet 2*d* having a fixed contact 2*c*, is placed on the reinforming plate 1. A case 3 is placed on the membrane switch 2, the case 3 having an annular first projecting portion 3*a* and a second projecting portion 3*b*. An operation member 4*a* of a key top 4 is movably positioned along an inner surface 3*c* of the first projecting portion 3*a*. The operation member 4*a* has a fastening claw at the lower end portion thereof so that the fastening claw is fitted within a recessed portion (omitted from illustration) formed in the first projecting portion 3*a*. As a result, the fastening claw can be moved within the recessed portion and the operation member 4*a* can be vertically moved along the inner surface 3*c*. Furthermore, a coil spring 5 is interposed between a flat surface 3*d* of the case 3 and the lower surface of the key top 4 in such a manner that the coil spring 5 is positioned around the first projecting portion 3*a*. In addition, another coil spring 6 is positioned in the operation member 4*a* by press-fitting for the purpose of pressing the movable contact 2*a* of the membrane switch 2. Although omitted from the illustration in FIG. 13, a recessed portion is formed in the second projecting portion 3*b* in a direction perpendicular to the direction of the drawing sheet for FIG. 13. As a result, the upward separation of the key top 4 is prevented by fastening the fastening claw provided for the key top 4 to the recessed portion.

Thus, when the key top 4 is depressed against the urging force of the coil spring 6, the outer portion of the operation member 4*a* is downwards moved along the inner surface 3*c*. As a result, the lower end portion of the coil spring 5 press-fitted in the operation member 4*a* presses the upper sheet 2*b* of the membrane switch 2, causing the movable contact 2*a* to be brought into contact with the fixed contact 2*b*. Therefore, the switch is switched on. When the pressure applied to the key top 4 is then released, the original state can be restored by the elastic restoring force of the coil spring 6.

Recently, there has been a desire for a compact keyboard having a reduced thickness, causing a necessity for reducing the thickness of the push button switch to arise.

When a push button switch having a reduced thickness is constituted, the push button switch must have a certain depressing stroke (3 to 4 mm).

It is assumed that the thickness of the key top 4 is b, the distance of the movement of the key top 4 is S, the length of a portion (omitted from illustration) for fastening the case 3 and the key top 4 is a, the thickness of the reinforcing plate 1 and the membrane switch 2 is c and the overall height is expressed by H.

Then, the length a of the fastening portion can be expressed by $a=H-(2S+b+c)$. In this case, the thickness b of the key top 4, the movement distance S of the key top 4 and the thickness c of the membrane switch 2 and the reinforcing plate 1 become substantially constant depending upon the molding condition and the parts composition. Therefore, there has conventionally been a necessity for the length a of the fastening portion to be shortened at the time of realizing the above-described thickness reduction.

However, if the length a of the fastening portion is shortened, the lower end portion of the operation member 4*a* of the key top 4 is caught by the inner surface of the first projecting wall 3*a* of the case 1 when the end portion A of the key top 4 is depressed. As a result, the conventional push button switch cannot be depressed smoothly.

SUMMARY OF THE INVENTION

Accordingly, an object of the present invention is to provide a push button switch which is able to overcome the above-described technical problem and which can be depressed smoothly.

A push button switch of the type described above has been arranged in such a manner that the key top 4 can be held by the housing so as to be capable of upwards/-downwards movement by inserting and bringing the stem 4*a* into contact with the inner surface 3*c* of the guide cylinder 3*a*. Therefore, an attempt has been made in that the height of the guide cylinder 3*a* is shortened for the purpose of reducing the thickness of the push button switch with maintaining a desired operation stroke. However, the length of the insertion of the stem 4*a* into the guide cylinder 3*a* inevitably becomes too short. As a result, the key top 4 may be easily inclined with respect to the housing 3 due to the small clearance necessary when the key top 4 is moved with respect to the housing. In particular, when an operator presses the edge of the key top 4, the stem 4*a* may be caught by the guide cylinder 3*a*. As a result, the push button switch cannot be smoothly depressed.

Accordingly, another object of the present invention is to provide a push button switch capable of overcoming the above-described technical problem, reducing the size and the thickness thereof and having a key top which can be smoothly depressed.

In order to achieve the above-described objects, a first aspect of the present invention lies in a push button switch including a case, a key top fastened to the case, and an elastic member disposed between the case and the key top and acting to upwards urge the key top and a contact portion positioned so as to confront a spring member fastened to an operation member of the key top so that the contact portion is pressed by the spring member when the key top is depressed, the push button switch comprising: a movable member disposed between the operation member of the key top and a projection wall of the case whereby the operation member and the movable member can be moved with respect to each other and the movable member and the projection wall can be moved with respect to each other.

A second aspect of the present invention lies in a push button switch including a housing having a guide cylinder, a key top having a stem and a restoring member disposed between the housing and the key top so that the contact is switched by upwards or downwards movement of the stem along the guide cylinder, the push button switch comprising: an actuator disposed between the guide cylinder and the stem in such a manner that the actuator is able to move with respect to the guide cylinder and the stem, whereby the contact is depressed by the actuator.

As described above, the push button according to the present invention is constituted in such a manner that the movable member is disposed between the operation member of the key top and the first projecting wall of the case. Therefore, the length of the portion for connecting the key top and the movable member and that for connecting the movable member and the case can be lengthened by the half of the distance of the movement in comparison to the conventional structure in which no movable member is provided assuming that the height of the push button is the same.

Furthermore, according to the above-described structure, the actuator moves with respect to the guide cylinder and the stem when the key top is depressed. Therefore, the height of the guide cylinder can be reduced without the necessity of shortening the distance of the movement. Furthermore, the contact can be pressed by the thus disposed actuator. Therefore, the diameter of the guide cylinder can be reduced.

Other and further objects, features and advantages of the invention will be appear more fully from the following description.

BRIEF DESCRIPTION OF THE DRAWINGS

FIGS. 1 and 2 respectively illustrate a first embodiment of the present invention, wherein FIG. 1 is a cross sectional view which illustrates an essential portion of a push button switch according to the present invention;

FIG. 2 is a cross sectional view which illustrates the push button switch shown in FIG. 1 when viewed from another side direction;

FIGS. 9 to 12 respectively illustrate a fourth embodiment of the present invention, wherein FIGS. 9 and 10 are cross sectional views which respectively illustrate the push button switch in a non-operated state when viewed from different directions;

FIG. 11 is a cross sectional view which illustrates the push button switch in a depressed state;

FIG. 12 is a perspective view which illustrates the actuator; and

DETAILED DESCRIPTION OF THE PREFERRED EMBODIMENTS

A first embodiment of the present invention will not be described with reference to FIGS. 1 and 2.

Figure 1:
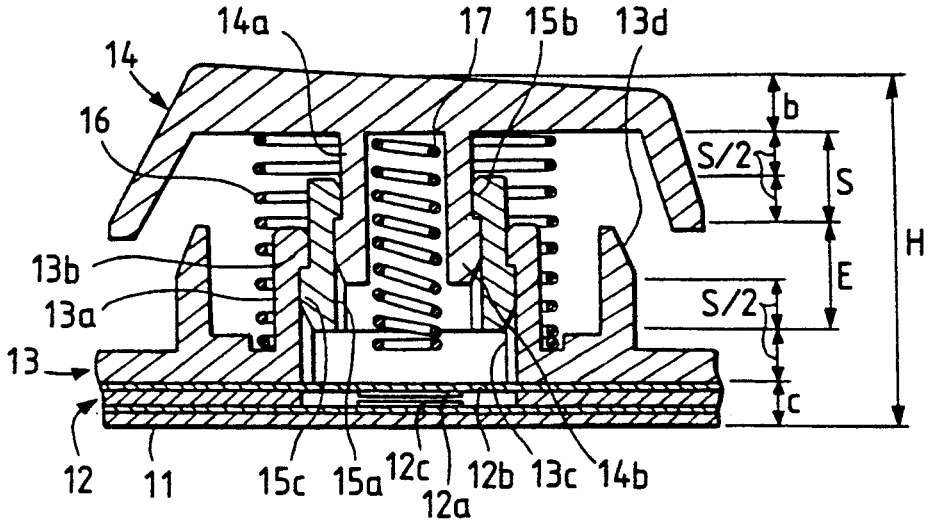
Figure 2:
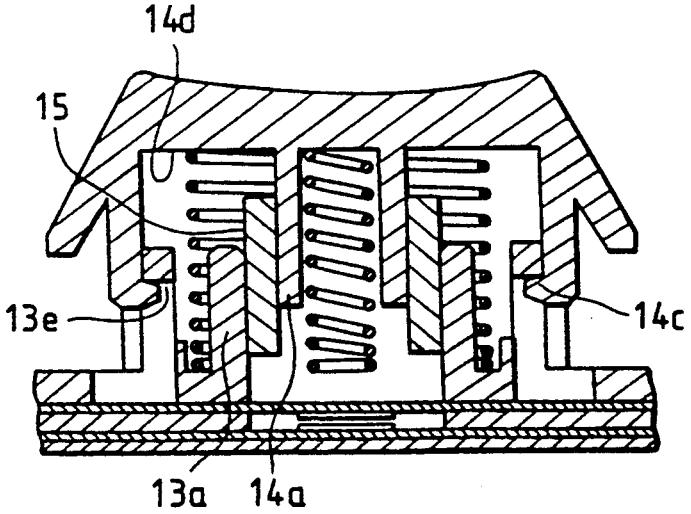

FIG. 1 is a cross sectional view which illustrates an essential portion of a push button switch according to the present invention. FIG. 2 is a cross sectional view which illustrates an essential portion of the push button switch shown in FIG. 1 when viewed from another direction.

Referring to the drawings, similarly to the conventional push button switch, the push button switch according to the present invention comprises a reinforcing plate 11, a membrane switch 12, a case 13, a key top 14 having an operation member 14*a*, a coil spring 16 serving as an elastic member for upwards urging the key top 14 in an initial stage and a coil spring 17 press-fitted in the operation member 14*a* of the key top 14. Then, the characteristics of the push button switch according to the present invention will be described.

That is, the essential characteristic of the present invention lies in a moving member 15 disposed between the operation member 14*a* of the key top 14 and a first projection wall 13*a* of the case 13. A fastening claw 14*b* is formed at the lower end portion of the operation member 14*a* of the key top 14, the fastening claw 14*b* being formed movably within a groove 15*a* formed in a movable member 15. A stopper portion 15*b* for stopping the upward separation of a fastening claw 14*b* is formed at the top end portion of the movable member 15, while a fastenng claw 15*c*, which is arranged to be engaged to a stopper portion 13*b* formed in a first projecting wall 13*a*, is formed at the lower end portion of the movable member 15. The fastening claw 15*c* is structured in such a manner that it can move within a groove 13*c* formed in the projecting wall 13*a*. A pair of fastening claws 14*c* is formed in the lower portion of the key top 14 at a position corresponding to the position at which a cut portion 13*e* is formed in a second projecting wall 13*d* so that the upward separation of the key top 14 is prevented.

When the key top 14 is depressed, the key top 14 is moved downwards against the urging force of the coil spring 16 serving as an elastic member which gives an upward urging force. At this time, the fastening claw 14*b* of the operation member 14*a* is moved downwards within the groove 15*a* formed in the movable member 15 until a lower surface 14*d* of the key top 14 comes in contact with the upper surface of the movable member 15. As a result, the fastening claw 15*c* of the movable member 15 moves within the groove 13*c*. Therefore, the outer surface of the operation member 14*a* moves along the inner surface of the first projecting wall 13*a* of the case 13. An upper sheet 12*b* of a membrane switch 12 is pressed by the bottom portion of the coil spring 17 fastened to the operation member 14*a*, causing a movable contact 12*a* to be brought into contact with a fixed contact 12*c*. As a result, the push button switch is switched on. Simultaneously, a lower surface 14*d* of the key top 14 is brought into contact with the upper surface of the first projecting wall 13*a*. When the pressure which is being applied to the key top 14 is released, the original state is restored by the elastic restoring force of the coil spring 16.

In a comparison made between the structure according to the present invention and the conventional structure, the thickness b of the key top 14 and the thickness c of each of the reinforcing plate 11 and the membrane switch 12 are the same as those according to the conventional structure. The difference will now be described.

It is assumed that the distance of the movement of the lower surface 14*d* of the key top 14 to come in contact with the top end portion of the first projecting wall 13*a* can be expressed by S. Furthermore, it is also assumed that each of the distance between the lower surface 14*d* of the key top 14 and the upper surface of the movable member 15 and the distance from the upper surface of the movable member 15 and the first projecting wall 13*a* is expressed by ½S. In addition, it is assumed that the distance between the lower surface of the operation member 14*a* of the key top 14 and the lower surface of the movable member 15 and the distance between the lower surface of the movable member 15 and the bottom surface of the case is ½S. Also assuming that the length between the top surface of the first projecting wall 13*a* and the lower surface (the fastening portion) of the movable member 15 is E, the overall height of the push button switch is expressed by $$H = \frac{3}{2} S + b, \text{ therefore, } b = H - \frac{3}{2} S.$$

On the other hand, the same relationship according to the conventional push button switch can be expressed by H=2S+a, therefore a=H−2S (however, the thickness c of the key top 14 and the thickness c of each of the reinforcing plate 11 and the membrane switch 12 are excluded from the above-described equation since they are the same for both the push button switches according to the present invention and the conventional structure). Then, the difference between the structure according to the present invention and the structure according to the conventional structure can be obtained by $$b - a = H = \frac{3}{2} S - (H - 2S),$$

therefore b=a+½S. Therefore, assuming that the height H of the push button switch according to the present invention and the same according to the conventional push button switch are the same, the fastening portion b can be allowed to have a size larger than the conventional fastening portion a by the size of ½S Therefore, assuming that the distance of the movement is 3 mm, the fastening portion b can be arranged to have a size larger than the conventional fastening portion a by 1.5 mm. As a result, an effect can be obtained in that the key top 14 cannot be operated deflectively even if the edge of the key top 14 is depressed.

Another embodiments of the present invention will be described.

Figure 3:
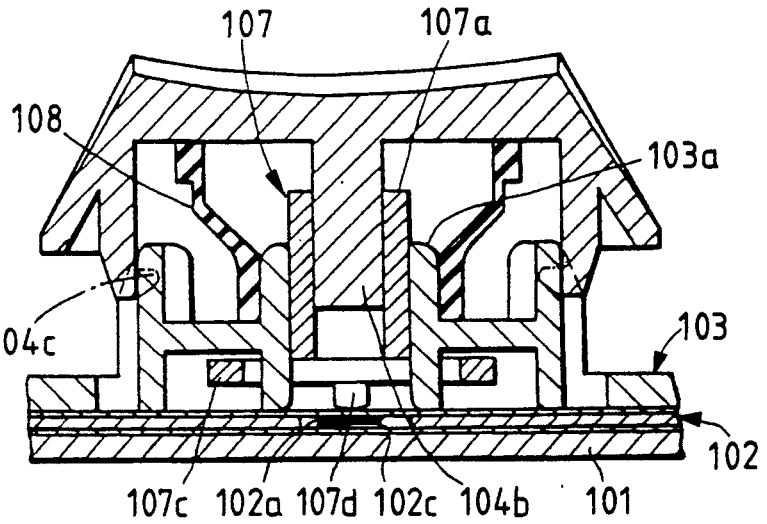
FIGS. 3 and 4 are cross sectional views which respectively illustrate the push button switch in a non-operated state and viewed from different directions.
Figure 4:
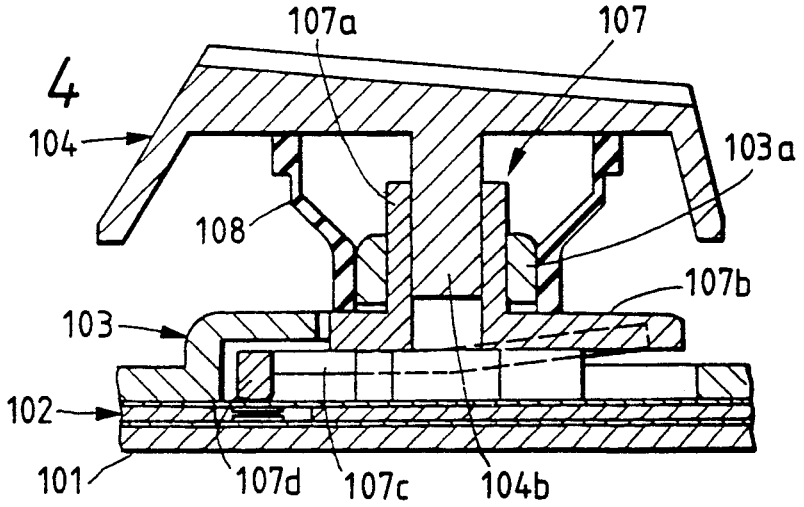
Figure 5:
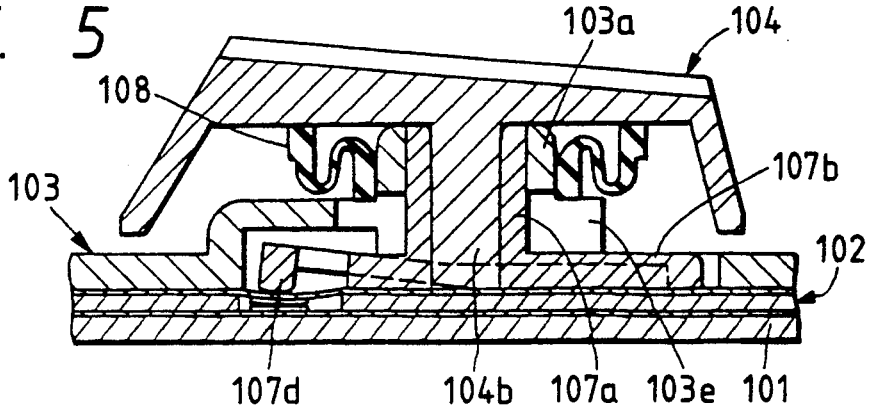
FIG. 5 is a cross sectional view which illustrates the push button switch in the depressed state.
Figure 6:
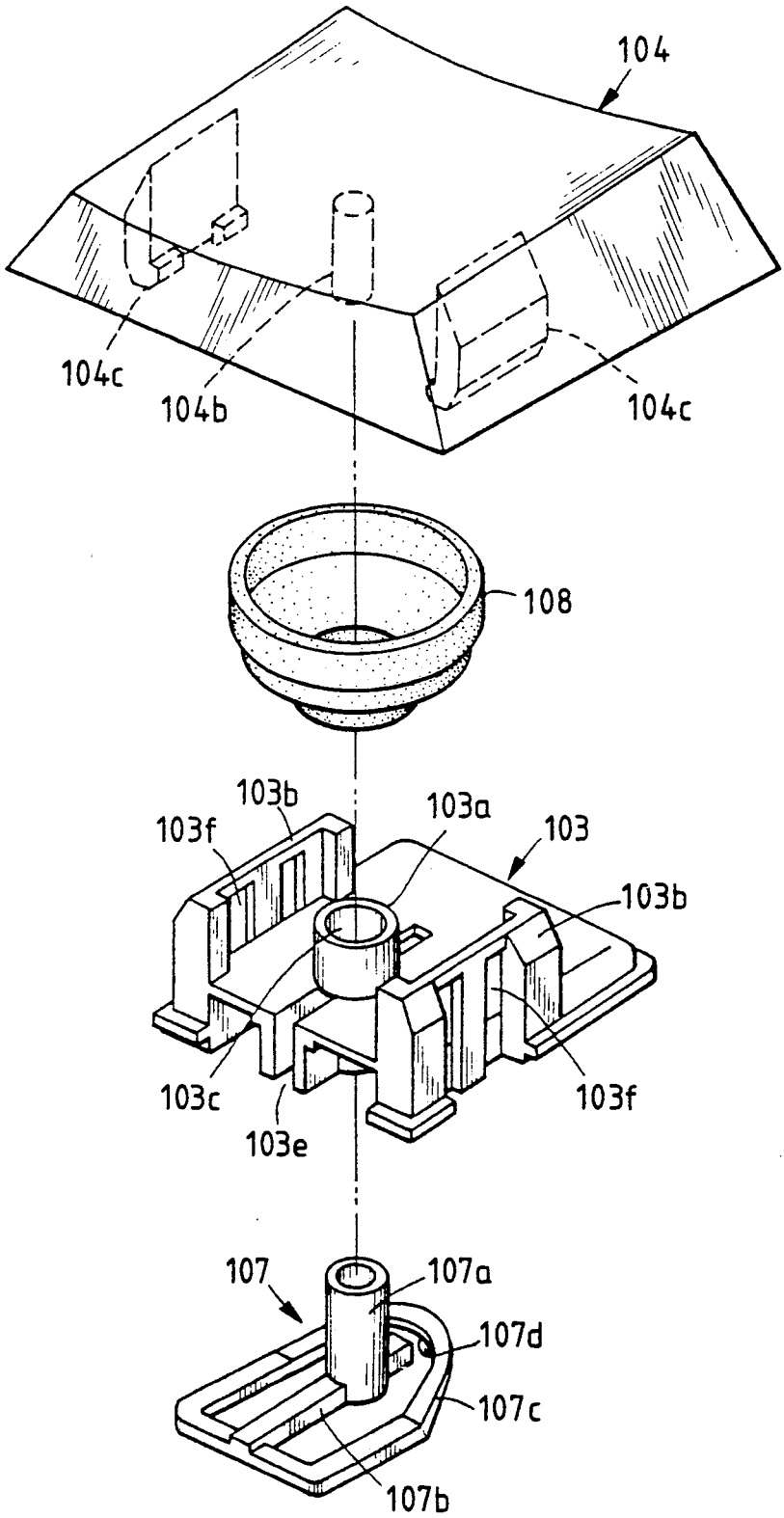
FIG. 6 is an exploded perspective view which illustrates the push button switch.

FIGS. 3 and 4 are cross sectional views which respectively illustrate the push button switch according to a second embodiment of the present invention when viewed from different directions. FIG. 5 is a cross sectional view which illustrates the state where the push button switch according to the second embodiment of the present invention is being depressed. FIG. 6 is an exploded perspective view of the same.

Referring to the drawings, reference numeral 107 represents an actuator comprising a hollow cylindrical portion 107*a*, a connecting portion 107*b* horizontally extending from the lower portion of the cylindrical portion 107*a* and an elastic member 107*c* in the form of a D-figure in a plan view and integrally formed with an end portion of the connecting portion 107*b*. A projection 107*d* for pressing the contact portion of a membrane 102 is formed in the elastic member 107*c*. The above-described cylindrical portion 107*a* is movably inserted into an inner wall 103*c* of a guide cylinder 103*a* of a housing 103. The abovedescribed connecting portion 107*b* is inserted into a guide groove 103*e* formed in the housing 103, the guide groove 103*e* being formed in such a manner that it crosses the guide cylinder 103*a*. Furthermore, the above-described elastic member 107*c* is disposed in a space formed between the housing 103 and the membrane switch 102.

The ceiling of the key top 104 has a rod-like stem 104*b* and and fastening claws 104*c* confronting each other with respect to the stem 104*b*, the stem 104*b* and the fastenng claws being so formed as to extend downwards. The stem 104*b* is movably inserted into the cylindrical portion 107*a* of the actuator 107 until it comes in contact with the top end portions of respective grooves 103*f* formed in projections 103*b*. As a result, the separation of the key top 104 from the housing 103 can be prevented. Furthermore, a click rubber 108 serving as the restoring member is disposed between the housing 103 and the key top 104. The click rubber 108 is arranged to be in the form of a downwards-tapered shape and has the top end large-diameter portion which is positioned so as to come in contact with the ceiling of the key top 104 and the lower end small-diameter portion which is fitted around the outer surface of the guide cylinder 103*a*. A reinforcing plate 101, a membrane switch 102 and the like are arranged to be the same as those according to the above-described conventional structure.

Then, the operation of the thus constituted push button switch will be described.

In a non-operated state shown in FIGS. 3 and 4, the key top 104 is positioned at the uppermost position of the stroke at which the fastening claws 104*c* are positioned in contact with the corresponding grooves 103*f* by the elastic force of the click rubber 108. At this time, the membrane 102 is turned off since the cylindrical portion 107*a* of the actuator 107 is not pressed by the key top 104.

When the key top 104 serving as a restoring member is depressed by an operator against the elastic force of the click rubber 108, the click rubber 108 is turned over with a click as shown in FIG. 5 so that the key top 104 is moved downwards. In this case, the stem 104*b* is downwards moved in the cylindrical portion 107*a* until the ceiling of the key top 104 comes in contact with the top end portion of the cylindrical portion 107*a*. As a result, the cylindrical portion 107*a* is downwards moved along the inner surface 103*c* of the guide cylinder 103*a*. Corresponding to the downward movement of the connecting portion 107*b* due to the same downward movement of the cylindrical portion 107*a*, the elastic member 107*c* is gradually deflected so that the contact portion of the membrane switch 102 is pressed by the projection 107*d*. As a result, the push button switch is switched on.

When the above-described pressure is released from the key top 104, the key top 104 is upwards moved to the uppermost position in the stroke shown in FIG. 4 due to the elastic force generated by the click rubber 108 and the elastic member 107*c*. Therefore, the membrane switch 102 is switched off.

As described above, according to this embodiment, the actuator 107 is provided between the stem 104*b* of the key top 104 and the guide cylinder 103*a* of the housing 103, the actuator 107 being able to move with respect to the stem 104*b* and the guide cylinder 103*a*. Therefore, the distance of the movement can be doubled in comparison to the conventional structure arranged in such a manner that the stem is moved along the guide cylinder in directly contact with each other. That is, the necessary height of the push button switch can be shortened with the smooth movement maintained to that obtainable from the conventional structure. Furthermore, the diameter of the stem 104*b* and that of the guide cylinder 103*a* can be reduced with respect to the diameter according to the conventional structure arranged in such a manner that the coil spring is used since the contact portion of the membrane switch 102 is pressed by the elastic member 107*c* integrally formed with the actuator 107. Therefore, a space capable of accommodating the click rubber 108 serving as the restoring member can be secured outside the guide cylinder 103*a*. As a result, the size of the push button switch can be reduced.

Figure 7:
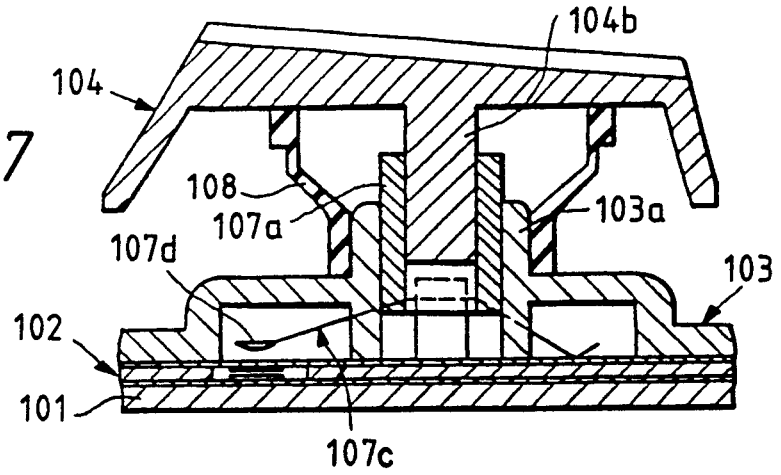
FIG. 7 is a cross sectional view which illustrates a third embodiment of the push button switch according to the present invention.
Figure 8:
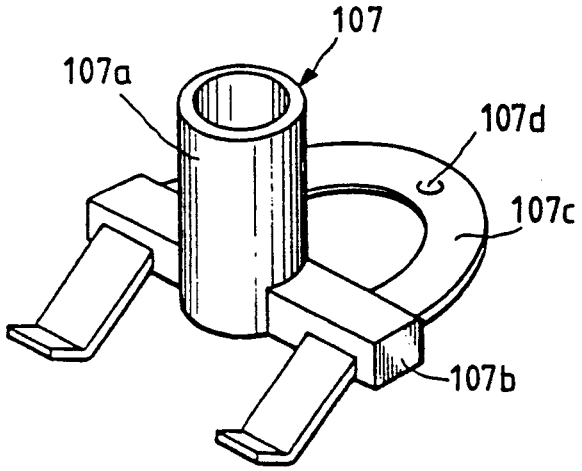
FIG. 8 is a perspective view which illustrates an actuator provided for the push button switch shown in FIG. 7.

FIG. 7 is a cross sectional view which illustrates the non-operated state of the push button switch according to a third embodiment of the present invention. FIG. 8 is a perspective view which illustrates the actuator provided for the push button switch shown in FIG. 7. Referring to the drawings, the elements which are the same as those shown in FIGS. 3 to 6 are given the same reference numerals.

The difference between this embodiment and the second embodiment lies in that the actuator 107 is constituted by fitting the elastic member 107*c* made of a metal elastic plate so as to surround the connecting portion 107*b* made of synthetic resin. The other structure and the operation are the same as those according to the second embodiment.

Figure 9:
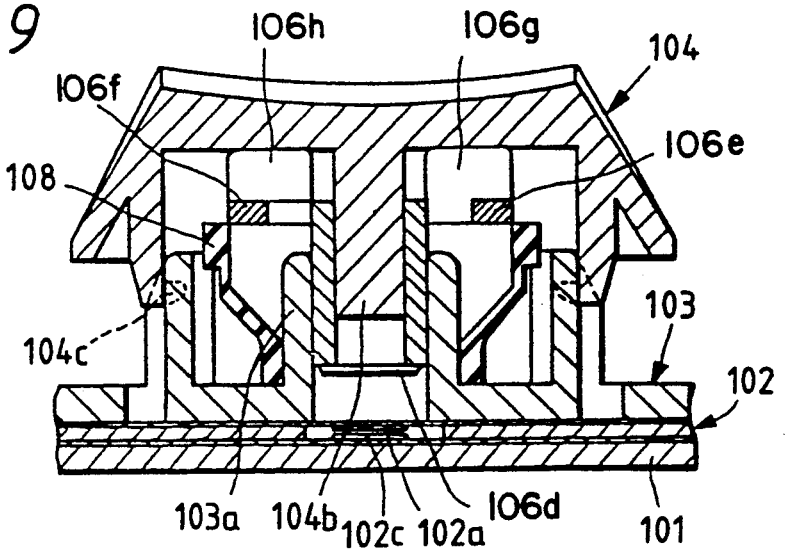
Figure 10:
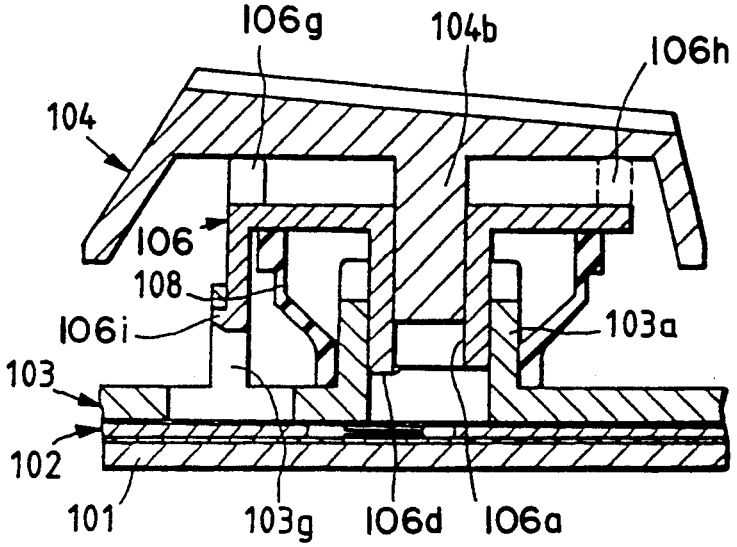
Figure 11:
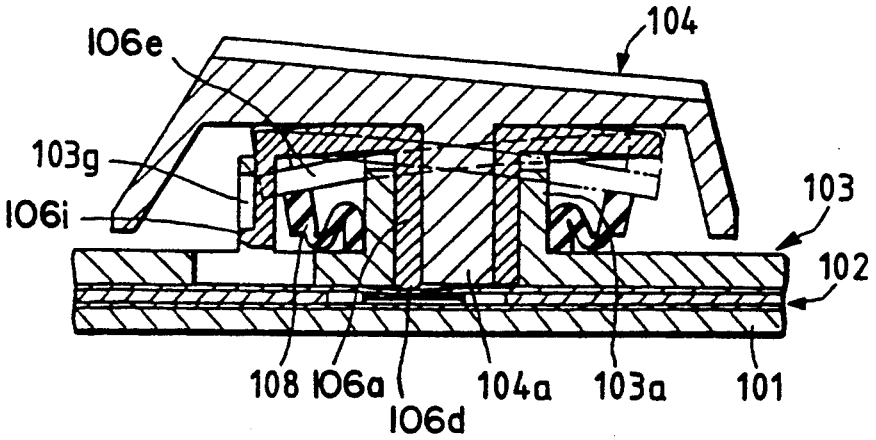
Figure 12:
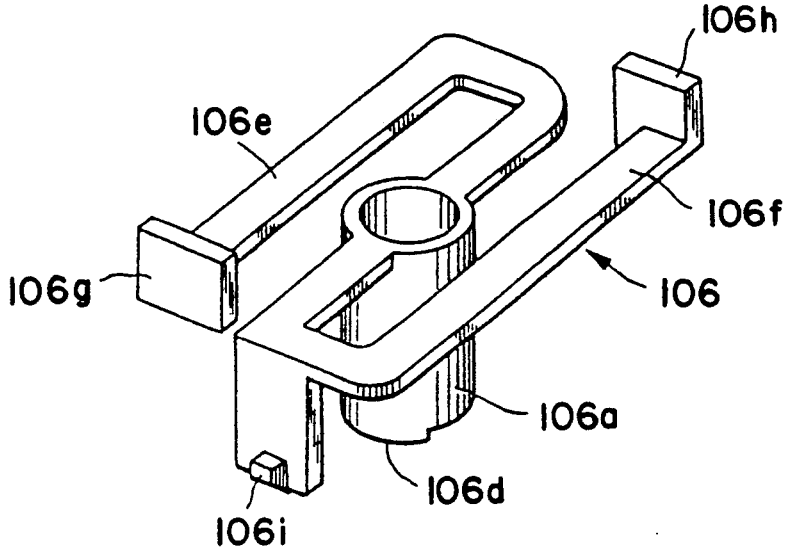
Figure 13:
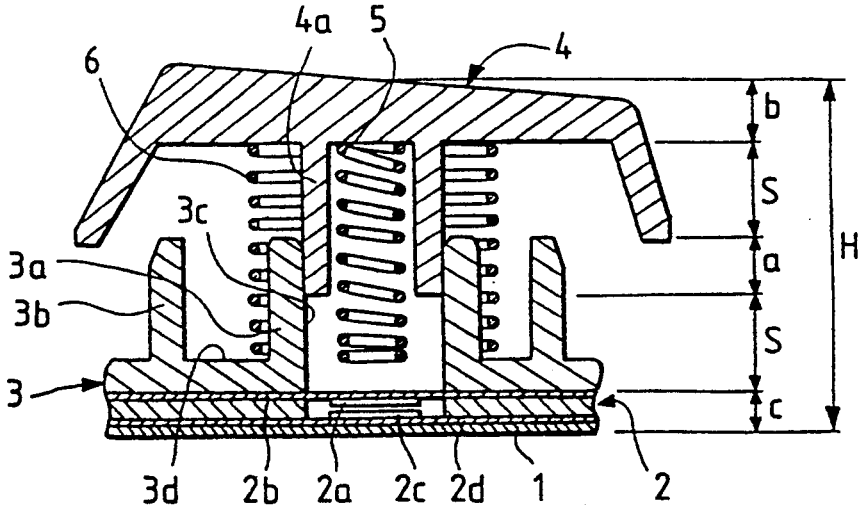
FIG. 13 PRIOR ART
FIG. 13 is a cross sectional view which illustrates a conventional push button switch.

FIGS. 9 and 10 are cross sectional views which illustrate the push button switch according to a fourth embodiment of the present invention when viewed from different directions. FIG. 11 is a cross sectional view which illustrates a state where the push button switch according to this embodiment is being operated. FIG. 12 is a perspective view which illustrates the actuator provided for the push button switch according to this embodiment. The same elements as those shown in FIGS. 3 to 6 are given the same reference numerals.

According to this embodiment, the actuator 106 comprises the hollow cylindrical portion 1o6*a* having the projection 106*d* at the lower end portion thereof, first and second legs 106*e* and 106*f* in the form of a crank and extending into opposite directions to each other from the top end portion of the cylindrical portion 106*d*, fastening portions 106*g* and 106*h* formed at the front end portions of the first and the second legs 106*e* and 106*f* and a stopper member 106*i* hung from a portion of the second leg 106*f*. The click rubber 108 is disposed between the housing 103 and the two legs 106*e* and 106*f* so as to elastically urge the fastening portions 106*g* and 106*h* against the ceiling of the key top 104. The above-described stopper member 106*i* is arranged so as to be capable of vertically moving in a stopper groove 103*g* formed in the housing 103. As a result, the separation of the actuator 106 from the housing 103 can be prevented. The other structure according to this embodiment is the same as that according to the second embodiment. Therefore, its description is omitted here.

When the key top 104 is depressed by an operator from the non-operated state shown in FIGS. 9 and 10, the cylindrical portion 106*a* is moved downwards along the inner surface of the guide cylinder 103*a* so that the click rubber 108 is turned over. Then, as shown in FIG. 11, the stem 104*b* is downwards moved along the inner surface of the cylindrical portion 106*a* so that the first and the second legs 106*e* and 106*f* are deflected. Thus, the contact portion of the membrane switch 102 is pressed by the projection 106*d* due to the resilience of the first and the second legs 106*e* and 106*f* so that the push button switch is switched on. When the above-described pressure applied to the key top 104 is released, the key top 104 is upwards moved to the uppermost position in the stroke shown in FIG. 10 due to the elastic force generated by the click rubber 108 and the two legs 106*e* and 106*f*. As a result, the membrane switch 102 is switched off.

In addition to the effect obtainable from the above-described second embodiment, an effect can be obtained according to the fourth embodiment in that an erroneous operation of contacts due to the dimensional error or deformation can be prevented since the projection 106*d* integrally formed with the lower end portion of the cylindrical portion 106*a* presses the contact portion of the membrane switch 102. Furthermore, since the stopper member 106*i* for preventing the separation of the actuator 106 from the housing 103 is provided for the actuator, the housing 103, the actuator 106 and the click rubber 108 can be previously prepared in the form of a semifinished products. Therefore, the assembling work can be facilitated.

According to the above-described second to the fourth embodiments, the click rubber 108 is employed as the member for restoring the key top 104. However, the present invention is not limited to this. A coil spring may be employed as an alternative to the click rubber 108 for forming a push button switch of a non-click type.

As described above, the push button switch according to the first embodiment of the present invention has the movable member 15 disposed between the case 13 and the key top 14. Therefore, the length of the fastening portion can be lengthened by a length corresponding to the half of the distance of the movement if the height of the push button switch and the distance of the movement of the push button switch are arranged to be the same as those according to the conventional push button switch. As a result, even if the edge of the key top 14 is depressed, the key top 14 is not depressed deflectively. Consequently, the push button switch can be satisfactorily smoothly depressed.

Furthermore, according to the push button switch according to the second to the fourth embodiments of the present invention, the height of the push button can be reduced with the distance of the movement maintained. In addition, the diameter of the guide cylinder and the stem can be reduced. Therefore, a compact push button switch also having a reduced thickness can be provided.

Although the invention has been described in its preferred form with a certain degree of particularly, it is understood that the present disclosure of the preferred form has been changed in the details of construction and the combination and arrangement of parts may be resorted to without departing from the spirit and the scope of the invention as hereinafter claimed.

What is claimed is:

1. A push button switch including a case having a projection wall, a key top fastened to said case, an first elastic member disposed between said case and said key top and acting to upwards urge said key top, a second elastic member, and a contact portion positioned so as to confront said second elastic member, wherein said key top includes an operation member for guiding movement of said key top such that said contact portion is pressed by said second elastic member when said key top is depressed, said push button switch comprising:

a movable member disposed between said operation member of said key top and said projection wall of said case whereby said operation member and said movable member can be moved with respect to each other and said movable member and said projection wall can be moved with respect to each other.

2. The push button switch as recited in claim 1 wherein said second elastic member is a coil spring.

* * * * *

UNITED STATES PATENT AND TRADEMARK OFFICE

CERTIFICATE OF CORRECTION

PATENT NO. : 5,120,923
DATED : June 9, 1992
INVENTOR(S) : Kato, et. al.

It is certified that error appears in the above-indentified patent and that said Letters Patent is hereby corrected as shown below:

Title page, item [75], Assignee should be -- Alps Electric Co., Ltd., Tokyo, Japan--.

Column 8, line 66, delete "an" and insert --a--.

Signed and Sealed this
Twenty-sixth Day of April, 1994

Bruce Lehman

*Attest:*

BRUCE LEHMAN

*Attesting Officer*

*Commissioner of Patents and Trademarks*